US010424241B2

(12) United States Patent
Tao et al.

(10) Patent No.: US 10,424,241 B2
(45) Date of Patent: Sep. 24, 2019

(54) DISPLAY PANEL WITH CONCURRENT GLOBAL ILLUMINATION AND NEXT FRAME BUFFERING

(71) Applicant: Google Inc., Mountain View, CA (US)

(72) Inventors: Yi Tao, Mountain View, CA (US); John Kaehler, Mountain View, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 15/463,097

(22) Filed: Mar. 20, 2017

(65) Prior Publication Data

US 2018/0144682 A1 May 24, 2018

Related U.S. Application Data

(60) Provisional application No. 62/425,156, filed on Nov. 22, 2016.

(51) Int. Cl.

| | |
|---|---|
| ***G09G 3/3225*** | (2016.01) |
| ***G09G 5/00*** | (2006.01) |
| ***G09G 3/3233*** | (2016.01) |

(52) U.S. Cl.

CPC ..... *G09G 3/3225* (2013.01); *G09G 3/3233* (2013.01); *G09G 5/001* (2013.01); *G09G 2300/0426* (2013.01); *G09G 2300/0814* (2013.01); *G09G 2300/0842* (2013.01); *G09G 2300/0852* (2013.01); *G09G 2300/0857* (2013.01); *G09G 2310/08* (2013.01); (Continued)

(58) Field of Classification Search

CPC ..... G09G 3/3225; G09G 5/001; G09G 2320/0233; G09G 2320/0626; G09G 2300/0426; G09G 2310/08; G09G 2360/18; G09G 2300/0842

See application file for complete search history.

(56) References Cited

U.S. PATENT DOCUMENTS

| | | |
|---|---|---|
| 6,249,269 B1 | 6/2001 | Blalock et al. |
| 7,375,701 B2 | 5/2008 | Covannon et al. |

(Continued)

FOREIGN PATENT DOCUMENTS

| | | |
|---|---|---|
| EP | 2472499 | 7/2012 |

OTHER PUBLICATIONS

Notice of Allowance dated May 3, 2018 for U.S. Appl. No. 15/476,643, 33 pages.

(Continued)

*Primary Examiner* — Premal R Patel

(57) ABSTRACT

A system includes a display panel having an input to receive pixel data representative of a sequence of display images and an array of display elements. Each display element includes a first buffer stage, a second buffer stage coupled to the first buffer stage, and a light emitting diode (LED) coupled to the second buffer stage. The display panel further includes a controller to control the array of display elements to concurrently activate the LEDs of the array for a first time interval based on pixel data of a first display image stored at the second buffer stages of the array of display elements and to receive and store at least a portion of pixel data of a second display image at the first buffer stages of the array of display elements during the first time interval.

13 Claims, 5 Drawing Sheets

(52) U.S. Cl.
CPC ..... *G09G 2320/0233* (2013.01); *G09G 2320/0626* (2013.01); *G09G 2350/00* (2013.01); *G09G 2360/18* (2013.01)

(56) References Cited

U.S. PATENT DOCUMENTS

| | | | | |
|---|---|---|---|---|
| 8,786,529 | B1 | 7/2014 | Chavez et al. | |
| 2010/0156964 | A1* | 6/2010 | Masuda | G09G 3/342 345/691 |
| 2011/0261037 | A1* | 10/2011 | Govil | G09G 3/3466 345/205 |
| 2012/0113077 | A1* | 5/2012 | Kang | G09G 3/003 345/211 |
| 2012/0146999 | A1 | 6/2012 | Hwang | |
| 2013/0215326 | A1 | 8/2013 | Sato | |
| 2013/0249883 | A1* | 9/2013 | Hwang | G09G 3/003 345/212 |
| 2014/0078267 | A1 | 3/2014 | Sato | |
| 2014/0139566 | A1* | 5/2014 | Han | G09G 5/10 345/691 |
| 2014/0197779 | A1* | 7/2014 | Horie | H02J 7/041 320/107 |
| 2014/0346475 | A1 | 11/2014 | Cho et al. | |
| 2015/0029218 | A1 | 1/2015 | Williams et al. | |
| 2015/0029239 | A1 | 1/2015 | Park | |
| 2016/0210906 | A1* | 7/2016 | In | G09G 3/3233 |
| 2016/0284265 | A1 | 9/2016 | Prache | |
| 2017/0309245 | A1 | 10/2017 | Richards et al. | |
| 2018/0005609 | A1* | 1/2018 | Konduru | G09G 5/393 |
| 2018/0033365 | A1* | 2/2018 | Zhang | G09G 3/3233 |

OTHER PUBLICATIONS

U.S. Appl. No. 15/476,643, filed Mar. 31, 2017, listing John Kaehler and Yi Tao as inventors, entitled, "Partial Memory Method and System for Bandwidth and Frame Rate Improvement in Global Illumination," 41 pages.

International Search Report and Written Opinion dated Nov. 10, 2017 for PCT Application No. PCT/US2017/052548, 15 pages.

Combined Search and Examination Report dated Mar. 19, 2018 for GB Application No. GB1715629.0, 8 pages.

Written Opinion of the International Searching Authority dated Nov. 13, 2018 for PCT Application No. PCT/US2017/052549, 8 pages.

International Preliminary Report on Patentability dated Jun. 6, 2019 for PCT Application No. PCT/US2017/052548, 9 pages.

* cited by examiner

DISPLAY PANEL WITH CONCURRENT GLOBAL ILLUMINATION AND NEXT FRAME BUFFERING

CROSS-REFERENCE TO RELATED APPLICATIONS

The present application claims priority to U.S. Patent Application Ser. No. 62/425,156, entitled "Display Panel with Concurrent Global Illumination and Next Frame Buffering" and filed on 22 Nov. 2016, the entirety of which is incorporated by reference herein. The present application is related to U.S. patent application Ser. No. 15/476,643, entitled "Partial Memory Method and System for Bandwidth and Frame Rate Improvement in Global Illumination" by John Kaehler et al., filed on Mar. 31, 2017, the entirety of which is herein incorporated by reference for all purposes.

BACKGROUND

Field of the Disclosure

The present disclosure relates generally to display panels and, more particularly, to display panels utilizing global illumination.

Description of the Related Art

Display panels utilizing organic light emitting diodes (OLEDs) may utilize one of two panel driving schemes: rolling scan and global illumination. For the rolling scan scheme, pixel data for a display image is sequentially transmitted on a row-by-row basis to a display panel. As each row of pixel data is received, a corresponding row of OLEDs of the display panel is illuminated according to the pixel data. For the global illumination scheme, the pixel data for a display image is transmitted to a display panel, and when the entire display image has been transmitted, all of the OLEDs of the display panel are illuminated at once for a corresponding global illumination period so as to display the display image. While the global illumination scheme often provides certain advantages over the rolling scan scheme, in conventional display panels utilizing global illumination no pixel data can be received by the display panel during the global illumination period. As a result, the frame period for each display image is effectively the sum of the time required to transmit all of the pixel data of the frame to the display panel plus the global illumination period. As the transmit rate of the interconnect between the source device providing the display image data and the display panel is fixed, the only way to improve the frame rate of a display panel utilizing the global illumination scheme is to reduce the duration of the global illumination period, which in turn results in a diminished effective brightness.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

Figure 1:
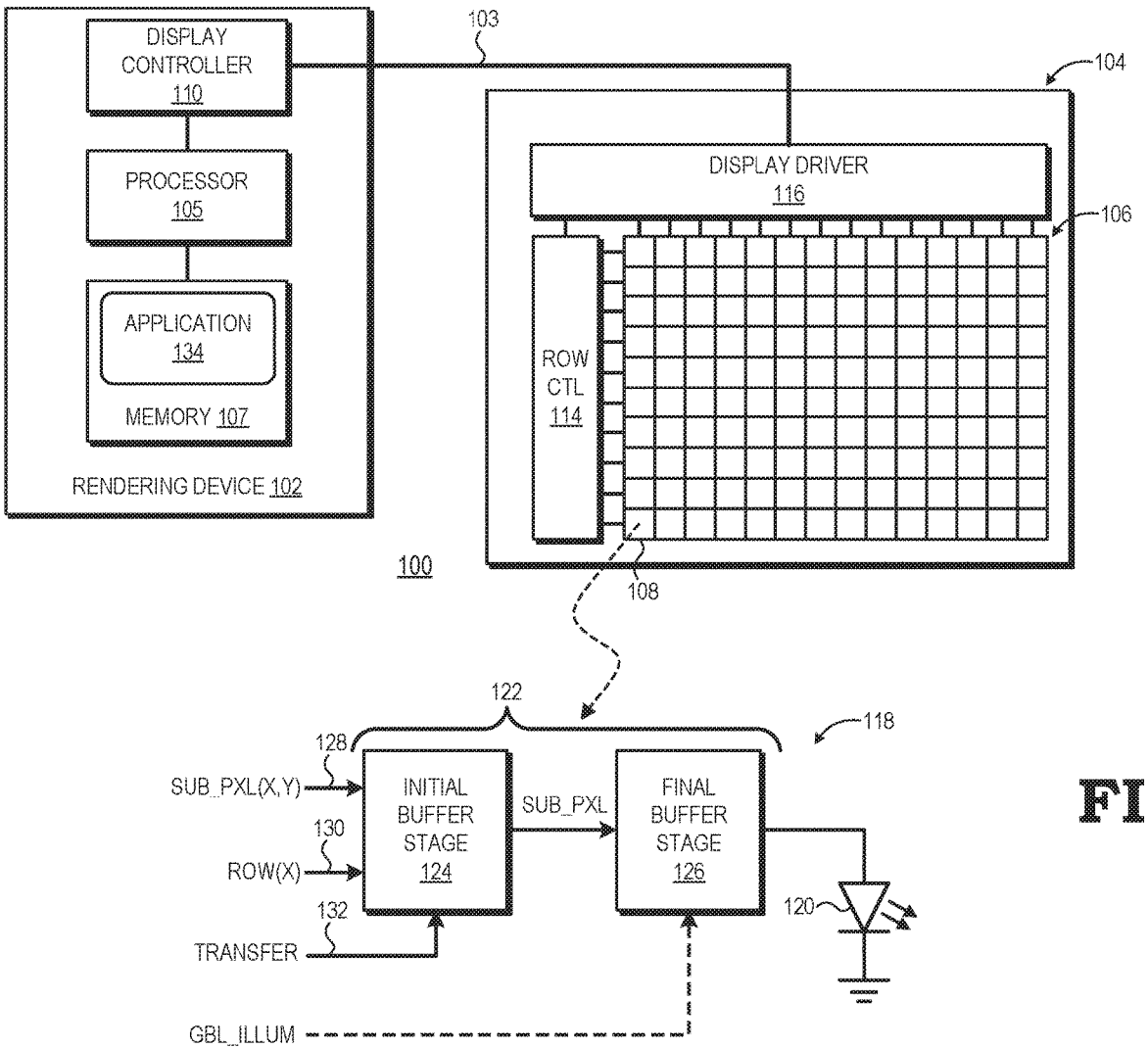
FIG. 1 is a block diagram of a display system utilizing a display panel implementing a double-buffered global illumination scheme in accordance with some embodiments.

Head-mounted display (HMD) devices and other near-eye displays often benefit from the brightness levels, excellent black state, high contrast ratio, and relatively low latency provided by display panels utilizing a global illumination scheme. However, such displays are often used in virtual reality (VR) applications, which typically require high frame rates in order to provide acceptable experiences to users. However, as the frame period (which is inversely proportional to the frame rate) of a display panel utilizing conventional global illumination schemes is relatively long due to exclusion of pixel data receipt at the display panel during the global illumination period, conventional global-illumination-based display panels may not be practicable for use in VR applications with high brightness/high frame rate requirements.

FIGS. 1-5 illustrate example systems and techniques employing a display panel that uses a global illumination scheme that allows at least a portion of a next display image to be displayed to be transmitted to a display panel while the display panel has activated a global illumination (that is, concurrently activated the LEDs of the display panel) to display the current frame. The display panel implements an array of display elements, with each display element representing a corresponding color component of a pixel of the display panel. Each display element includes a light emitting diode (LED) and a two-stage control circuit for controlling the LED. The two-stage buffer circuit includes an initial buffer stage and a final buffer stage, each of which includes a capacitor or other storage element that enables storage of a sub-pixel value. A rendering device generates a sequence of display images and transmits each display image in sequence to the display panel. As a display image is received, the pixel values of the pixel data representing the display image are initially buffered in the initial buffer stages of the array of display elements, with each sub-pixel value of the display image being stored at a corresponding initial buffer stage.

After the preceding display image has been displayed at the display panel, the pixel values of the display image initially buffered in the initial buffer stages of the array of display elements is transferred for storage in the final buffer stages of the array of display elements. When transfer of the pixel data is complete, a global illumination of the display panel is initiated, which causes the final buffer stage of each display element to activate the LED of the display element according to the pixel value stored at the final buffer stage. In this manner, the final buffer stages control the LEDs to affect a display of the display image by the display panel. Moreover, because the pixel data has been transferred out of the initial buffer stages and thus storage elements of the initial buffer stages are effectively empty, the rendering device can begin transfer of the pixel data of the next display image to be displayed to the display panel for storage at the initial buffer stages of the array concurrent with the global illumination of the current display panel based on the pixel data stored in the final buffer stages. Thus, the array of display elements, in effect, operates with double buffering such that receipt and buffering of the pixel data of the next display image occurs concurrent with the global illumination of the LEDs of the display elements using the pixel data of the current display image. Accordingly, the global illumination scheme described herein is referred to as a "double-buffering global illumination scheme" for ease of reference.

By facilitating the transfer and buffering of the next display image concurrent with the global illumination of the current display image at the display panel, the double-buffering global illumination scheme described herein results in a frame period that is less than the sum of the data transfer time for transferring the pixel data of a display image over an interconnect of a given transfer speed and the duration of the global illumination interval used to activate the LEDs to illuminate the image. That is, because data transfer can occur concurrent with global illumination, given the same interconnect transfer speeds and global illumination interval, the double-buffering global illumination scheme can provide a faster frame rate than conventional global-illumination schemes, which prevent receipt of pixel data at a display panel during the global illumination interval. Alternatively, because pixel data can be transferred and buffered during a global illumination interval, the duration of the global illumination interval may be extended without increasing the effective frame period, and thus allowing each display image to be displayed with greater brightness for a given frame rate compared to conventional global illumination schemes.

FIG. 1 illustrates a display system 100 implementing a double-buffering global illumination scheme in accordance with at least some embodiments of the present disclosure. As depicted, the display system 100 includes a rendering device 102 and a display panel 104 connected via an interconnect 103. The rendering device 102 includes a processor 105, a memory 107 or other non-transitory computer readable medium, and a display controller 110. The processor 105 may comprise one or more central processing units (CPUs), one or more graphics processing units (GPUs), or a combination thereof. The display panel 104 includes a two-dimensional array 106 of display elements 108, a row controller 114, and a display driver 116. The controllers 110 and 116 each may be implemented as hard-coded logic (e.g., an application specific integrated circuit (ASIC), programmable logic (e.g., a field programmable gate array (FPGA), or a combination thereof. The interconnect 103 may include any of a variety of interconnects utilized to connect a display panel to a corresponding device or other display sub-system, such as an interconnect based on one or more interconnects standards, such as an inter-integrated circuit (I2C)-based standard, a DisplayPort™-based standard, a high-definition multimedia interface (HDMI)-based standard, one or more proprietary interconnect configurations, or a combination thereof.

Each display element 108 of the array 106 represents a corresponding color component of a corresponding pixel of the display panel 104, and includes an organic light emitting diode (OLED) or other LED that is controlled by a corresponding drive circuit so as to illuminate at a specified brightness or intensity. To illustrate, for a display panel utilizing a red-green-blue (RGB)-based pixel scheme, each pixel of the display panel includes a red-component display element, a green-component display element, and a blue-component display element, where the red-component display element includes a red-colored OLED and is controlled by the red sub-pixel value of the pixel value assigned to the display pixel, the green-component display element includes a green-colored OLED and is controlled by the green sub-pixel value of the pixel value assigned to the display pixel, and the blue-component display element includes a blue-colored OLED and is controlled by the blue sub-pixel value of the pixel value assigned to the display pixel. Thus, the array 106 may be considered to have a plurality of sub-arrays of display elements of the different color components, such as a sub-array of red display elements, a sub-array of green display elements, and a sub-array of blue display elements for the RGB example described above.

Expanded view 118 illustrates an example implementation of each display element 108 of the array 106. As noted above, each display element 108 includes an OLED 120 controlled by a drive circuit 122. Although the LED of the display element 108 is identified as an OLED, in other embodiments other types of LEDs may be used. Thus, reference to OLED herein may apply instead to other LED types unless otherwise noted. In at least one embodiment, the drive circuit 122 is a two-stage, or double-buffered, drive circuit having an initial buffer stage 124 and a final buffer stage 126. The initial buffer stage 124 includes an input to receive the sub-pixel value of the pixel value assigned to the corresponding display pixel at array position (X,Y) of which the display element 108 forms a part. This sub-pixel value is identified herein as SUB_PXL(X,Y) and also identified in FIG. 1 as sub-pixel value 128. The initial buffer stage 124 further includes an input to receive a write assert signal (identified as "ROW(X)" or signal 130) for the row X at which the display element 108 is located within the array 106. The initial buffer stage 124 further includes an input to receive a global signal, identified as "TRANSFER" or signal 132. The initial buffer stage 124 further includes a storage element (not shown in FIG. 1) to store the sub-pixel value SUB_PXL(X,Y) and an output to provide the stored sub-pixel value in response to an assertion of the TRANSFER signal. The final buffer stage 126 includes an input coupled to the output of the initial buffer stage 124 to receive the stored sub-pixel value, a storage element (not shown in FIG. 1) to store the received sub-pixel value, and an output to control the operation of the OLED 120 based on the sub-pixel value stored at the storage element of the final buffer stage 126.

As a general operational overview, the display system 100 operates to generate and display a sequence of display images to a user. To this end, the memory 107 stores a software application 134 that, when executed by the processor 105 or other processor of the rendering device 102, manipulates the processor 105 to generate a sequence of display images that together represent a video sequence. This sequence of display images may comprise completely computer-rendered imagery, such as video generated to represent a user's viewpoint into a VR scene (that is, VR content), entirely captured imagery, or a combination of captured imagery and computer-rendered imagery, such as found in augmented-reality (AR) content. Each generated display image is provided to the display controller 110 in sequence, and the display controller 110 in turn transmits the pixel data of each display image in sequence to the display panel 104 via the interconnect 103 on a row-by-row basis.

As each row of pixel data is received at the display panel 104, the row is buffered in the display driver 116. The display driver 116 and row controller 114 operate together to write the pixel data buffered in the display driver 116 to the display elements 108 of the corresponding row of the array 106. In particular, each sub-pixel value of the row is initially buffered at the storage element of the initial buffer stage 124 of a corresponding display element 108. Then, when all rows of the display image have been received and buffered, the display driver 116 asserts the global signal TRANSFER, which causes the buffered sub-pixel values to be transmitted from the initial buffer stages 124 to the final buffer stages 126. When this transfer is complete, the display driver 116 initiates global illumination of all of the OLEDs 120 of array 106 for a corresponding global illumination interval, where the intensity of each OLED 120 is controlled by the final buffer stage 126 based on the sub-pixel value stored at its storage element. Thus, in this manner the display image is displayed to the user during the global illumination interval.

In a conventional global illumination scheme, the display panel 104 is unable to receive any substantial amount of pixel data for the next display image while the global illumination is occurring for the current display image. However, for the display system 100 of FIG. 1, because the drive circuit 122 of each display element 108 is double-buffered, when the sub-pixel values are transferred from the initial buffer stages 124 to the final buffer stages 126 of the display elements 108, the initial buffer stages 124 become available to receive and initiate buffering of, the sub-pixel values of the next display image in the sequence. Accordingly, after the global signal TRANSFER has been asserted and thus triggering the transfer of sub-pixel values of the current display image, the display controller 110 may initiate transfer of pixel data for the next display image to the display panel 104 such that the sub-pixel values of the received pixel data are buffered in the recently-vacated initial buffer stages 124 of the display elements 108. This initial buffering may be performed in a manner that does not impact the final buffer stage 126, and thus the transfer and buffering of the next display image at the display panel 104 may initiate during the global illumination interval for the current display image, and thus allowing display of the current display image and receipt and buffering of the next display image to occur concurrently at the display panel 104. As described in greater detail herein, the ability to buffer the next display image while the current display image is being globally illuminated enables the display frames to be driven to the display panel at a greater frame rate than conventional global illumination schemes, enables the display images to be illuminated longer compared to conventional global illumination schemes for the same given frame rate, or a combination of increased frame rate and longer display image illumination may be achieved.

Figure 2:
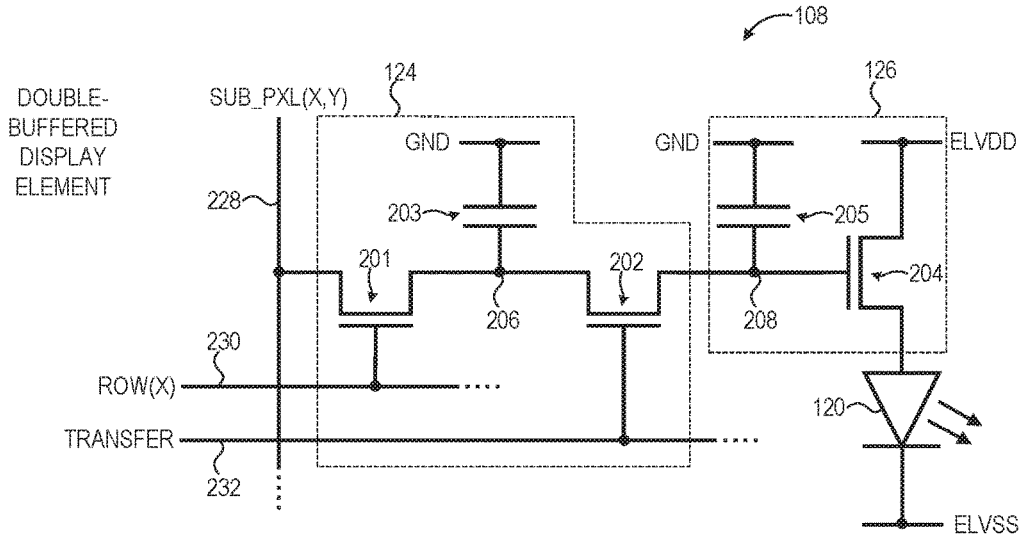
FIG. 2 is a diagram illustrating an example circuit implementation for a display element of the display panel of FIG. 1 in accordance with some embodiments.
Figure 2:
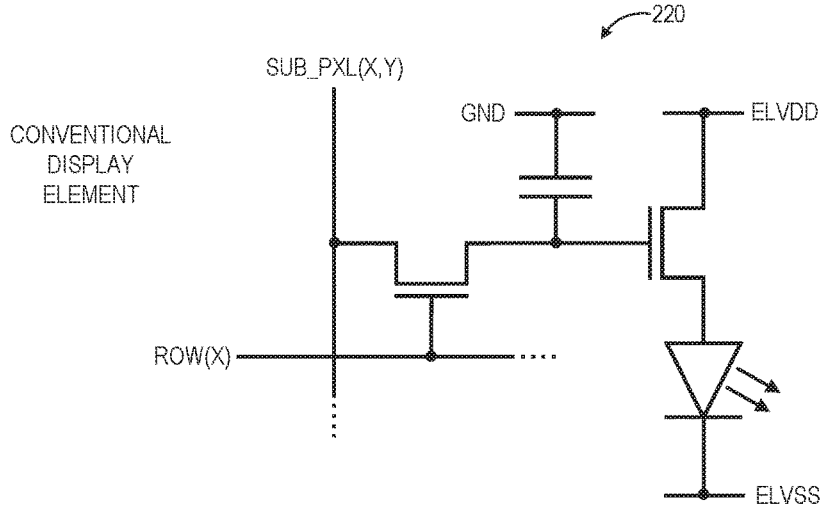

FIG. 2 illustrates an example implementation of the double-buffered display element 108 in greater detail in accordance with at least one embodiment. Although FIG. 2 illustrates a particular example circuit implementation, the present disclosure is not limited to this circuit implementation. Rather, one of ordinary skill in the art will appreciate that any of a variety of circuits utilizing two-stage sub-pixel data buffering and transfer may be utilized in accordance with the guidelines provided herein. In the depicted example, the initial buffer stage 124 includes transistors 201 and 202 and capacitor 203, and the final buffer stage 126 includes transistor 204 and capacitor 205. For depicted implementation, the transistors 201, 202, 204 are n-channel field-effect transistors (FETs). However, other transistor types, such as bipolar junction transistors (BJTs), may be used with appropriate modification using the guidelines provided herein. Likewise, rather than using n-channel transistors, the illustrated circuit may use p-channel transistors with appropriate modification using guidelines provided herein.

The capacitor 203 serves as the storage element of the initial buffer stage 124, while the capacitor 205 serves as the storage element of the final buffer stage 126. The transistor 201 includes a current electrode serving as an input coupled to a transmission line 228 that carries a voltage representing the corresponding sub-pixel value SUB_PXL(X,Y) (signal 128) for the pixel value at location (X,Y) corresponding to the location of the display element 108, a current electrode coupled to an electrode of the capacitor 203 via a node 206, while the other electrode of the capacitor 203 is coupled to a low potential voltage reference (e.g., GND). The gate electrode of the transistor 201 serves as an input coupled to a transmission line 230 that carries the write enable signal ROW(X) (signal 130) for the row X of the array 106 at which the display element 108 is located. The transistor 202 includes a current electrode coupled to a node 208, a current electrode coupled to the node 206, and a gate electrode serving as an input coupled to a transmission line 232 that carries the global signal TRANSFER (signal 132).

Turning to the final buffer stage 126, the capacitor 205 includes an electrode coupled to the node 208 (and thus to a current electrode of the transistor 202), while the other electrode of the capacitor 205 is connected to the same low potential voltage reference (e.g., GND). The transistor 204 includes a current electrode coupled to a high potential voltage reference ELVDD, a current electrode coupled to an anode of the OLED 120, and a gate electrode coupled to the node 208. The cathode of the OLED 120 is coupled to an adjustable, or variable, voltage reference ELVSS.

As a general summary of operation, to input the sub-pixel value SUB_PXL(X,Y), ELVSS and ELVDD both are initially pulled "high" (that is, to a high voltage potential) and a driver on column Y of the display driver 116 (FIG. 1) drives a voltage on the line representing SUB_PXL(X,Y) while the row controller 114 (FIG. 1) asserts the ROW(X) signal. The assertion of ROW(X) causes transistor 201 to turn "on" or become conductive, thereby causing a charge representative of the voltage representing SUB_PXL(X,Y) to be stored at the capacitor 203. When the global signal TRANSFER is asserted, the transistor 202 is activated, thereby causing the charge on the capacitor 203 to transfer to the capacitor 205. In this implementation, a global illumination interval is triggered by pulling ELVSS to a low voltage potential. When this happens, the OLED 120 is selectively activated based on the charge present at the capacitor 203 (which is a representation of the value SUB_PXL(X,Y)), as this charge controls the activation of the transistor 204, which in turn controls the flow of current between ELVDD and ELVSS through the OLED 120. When the global illumination interval is to end, ELVSS is pulled back to a high reference voltage, thereby ceasing the flow of current through the OLED 120 and thus terminating any illumination by the OLED 120.

Due to its role in transferring charge from the capacitor 203 to the capacitor 205, the transistor 202 acts as a "gate" between the initial buffer stage 124 and the final buffer stage 126. Thus, by deasserting the global signal TRANSFER after the charge has transferred to the capacitor 205, the sub pixel value of the corresponding pixel of the next display image may be transferred as a representational charge to the capacitor 203 without effecting the operation of the capacitor 203 and transistor 204 in controlling the OLED 120. Thus, with the transistor 202 deactivated, the capacitor 203 and transistor 204 may operate to control the OLED 120 during a global illumination interval while the next sub-pixel value is received and buffered in the capacitor 203 of the initial buffer stage 124. It should be noted that this transfer of the sub pixel value from the initial buffer stage 124 and the final buffer stage 126 typically is significantly shorter than the global illumination period or the pixel row transfer period. Thus display of one display image via global illumination and receipt and buffering of at least a portion of the pixel data of a next display image may occur concurrently at the display panel 104.

In contrast, display elements of conventional display panels implementing a global illumination scheme lack the double-buffering facility of the display element 108, and thus are unable to buffer pixel data while globally illuminating the display elements. To illustrate, FIG. 2 also illustrates an example circuit implementation of a conventional display element 220 of a conventional display panel. As shown, this conventional display element 220 has only a single buffer stage and thus cannot concurrently control a corresponding OLED based on one buffered sub-pixel value while also buffering a next sub-pixel value. Thus, with the conventional display element 220 a conventional display panel must wait until a global illumination interval has ended before the display panel can begin receiving the pixel data for the next display image to be displayed. As explained in greater detail below, this delay in receipt of the next display image results in lower frame rates and lower effective brightness than otherwise can be achieved through the double-buffering approach described herein.

Figure 3:
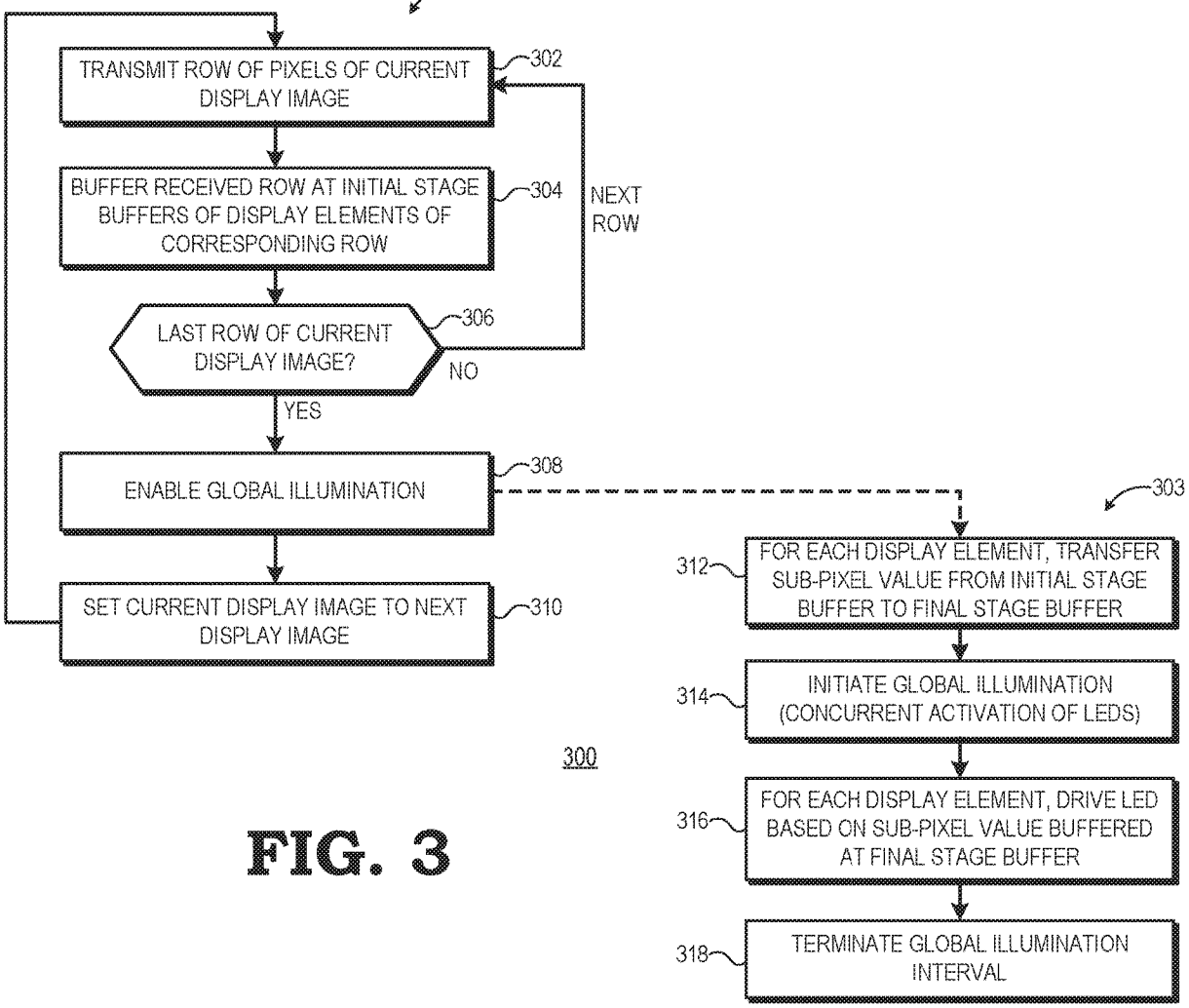
FIG. 3 is a flow diagram illustrating an example method for a double-buffered global illumination scheme for a display panel in accordance with some embodiments.

FIG. 3 illustrates an example method 300 of operation of the display system 100 of FIG. 1. For ease of description, the method 300 is described in the context of the example circuit implementation of the display element 108 as shown by FIG. 2. However, the same principles described herein may be applied to other double-buffered implementations of the display element 108 using the guidelines provided herein.

As described above, the software application 134 controls the processor 105 of the rendering device 102 to generate a sequence of display images, and the display controller 110 operates to sequentially transmit these display images on a row-by-row basis to the display panel 104 via the interconnect 103. As illustrated, the method 300 includes two sub-processes, sub-process 301 and sub-process 303, which may operate in parallel after the first display image is received and initially buffered at the display panel 104. The sub-process 301 initiates at block 302 with the transmission of the first row of pixel data for the first display image of this sequence. As noted above, each row of a display image is represented by a corresponding row of pixels, with each pixel having a pixel value, and each pixel value having one or more sub-pixel values, with each sub-pixel value representing an intensity or level of a corresponding color component for that pixel. To illustrate, each pixel of a display image may be represented by a 24-bit pixel value, with the first eight bits representing the red color component of the pixel, the next eight bits representing the blue color component of the pixel, and the last eight bits representing the green color component of the pixel. As each row of pixel data of the current display image is received at the display panel 104, the row of pixel data is buffered at the display driver 116 for further processing.

At block 304, the display panel 104 transfers the pixel data buffered in the display driver 116 to the display elements 108 of the corresponding row of the array 106 by buffering each sub-pixel value of the pixel values in the initial buffer stages 124 of the corresponding display elements 108. As explained above, this buffering may be accomplished for each sub-pixel value by the display driver 116 driving a representative voltage on the column line corresponding to the sub-pixel value (i.e., SUB_PXL(X,Y)) and the row controller 114 asserting the write enable signal ROW(X) for the corresponding row so as to cause the capacitor 203 of each display element 108 of that row to store a charge representative of the corresponding voltage of SUB_PXL(X,Y).

At block 306, the display driver 116 determines if the row of pixel data received during the current iteration of blocks 302 and 304 is the last row of the current display image. If not, the method 300 returns to block 302 for the transfer of the next pixel row from the display controller 110 to the display panel 104 and the corresponding buffering of the pixel data in the initial buffer stages 124 of the display elements 108 of the corresponding row. Otherwise, if the row of pixel data received during the current iteration is the last row of the current display image, the display driver 116 notes the end of receipt of the current display image, and in response, at block 308 enables activation of global illumination of the display panel 104 so as to display this current display image, and at block 310 identifies the next display image as now being the current display image being received, and iterations of sub-process 301 commence for this next display image.

The display driver 116 enabling activation of global illumination triggers at block 308 of sub-process 301 triggers an iteration of sub-process 303. At block 312 of sub-process 301, the display driver 116 transfers the sub-pixel values stored at the initial buffer stages 124 of the display elements 108 of the array 106 by asserting the global signal TRANSFER, which is distributed to each display element 108 of the array 106. As described above, the assertion of the global signal TRANSFER causes the transistor 202 of the initial buffer stage 124 to activate, and thereby transferring the charge in the capacitor 203 (which represents the sub-pixel value of the current display image) to the capacitor 205 of the final buffer stage 126, and thus in effect transferring the sub-pixel values for the current display image from the initial buffer stages 124 to the final buffer stages 126 of the display elements.

When this transfer has completed for the array 106, at block 314 the display driver 116 initiates a global illumination interval so as to have the current display image illuminated by the OLEDs 120 of the array 106 (that is, to "display" the current display image). In the example circuit implementation of FIG. 2, the global illumination interval is initiated by pulling ELVSS down to a low voltage reference. In other circuit implementations, the global illumination interval may be controlled via assertion of a global illumination signal, which in turn activates a circuit that controls the OLED 120.

With the global illumination interval triggered, at block 316 the final buffer stage 126 of each display element 108 controls the OLED 120 of the display element 108 based on the sub-pixel value stored at the final buffer stage 126. In the example circuit implementation of FIG. 2, the charge stored in the capacitor 205 represents the stored sub-pixel value, and this charge in turn controls the activation of the transistor 204, which in turn controls the amount of current driving the OLED 120, and thus controls the brightness of the OLED 120. After the global illumination interval has progressed for a specified duration, at block 318 the display driver 116 terminates the global illumination interval by pulling ELVSS up to a high voltage reference or, if a separate global control signal is used, deactivating this global signal.

As the parallel nature of sub-processes 301, 303 illustrates, the double-buffering approach to the display elements 108 allows the display image receipt and initial buffering process represented by sub-process 301 to proceed in a decoupled manner from the global illumination process represented by sub-process 301, and thus the global illumination interval does not serve to block or prevent any concurrent pixel data transfer as it does in conventional global illumination schemes.

Figure 4:
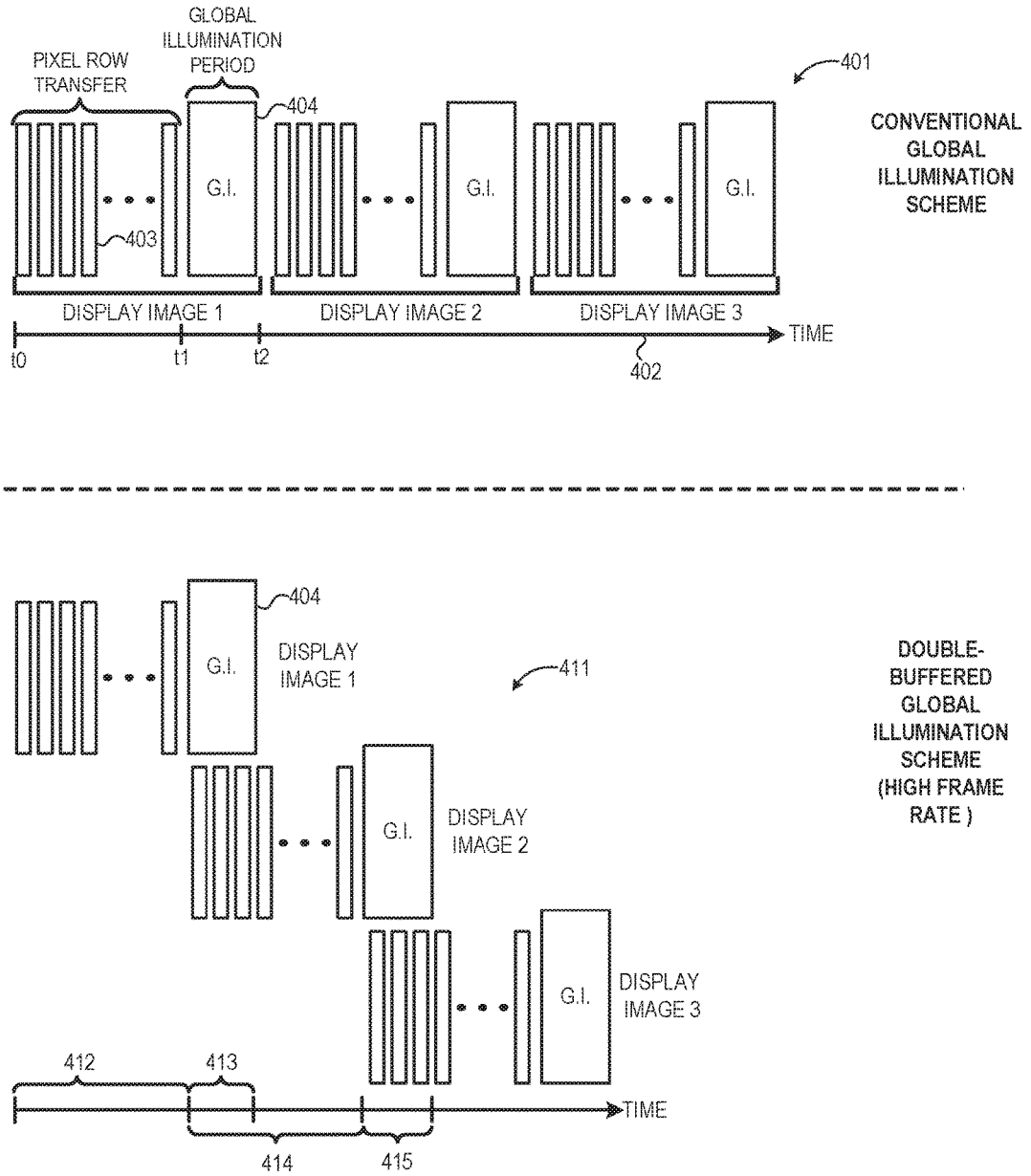
FIGS. 4 and 5 are diagrams illustrating a comparison of a conventional global illumination scheme with two variations of a double-buffered global illumination scheme in accordance with some embodiments.
Figure 5:
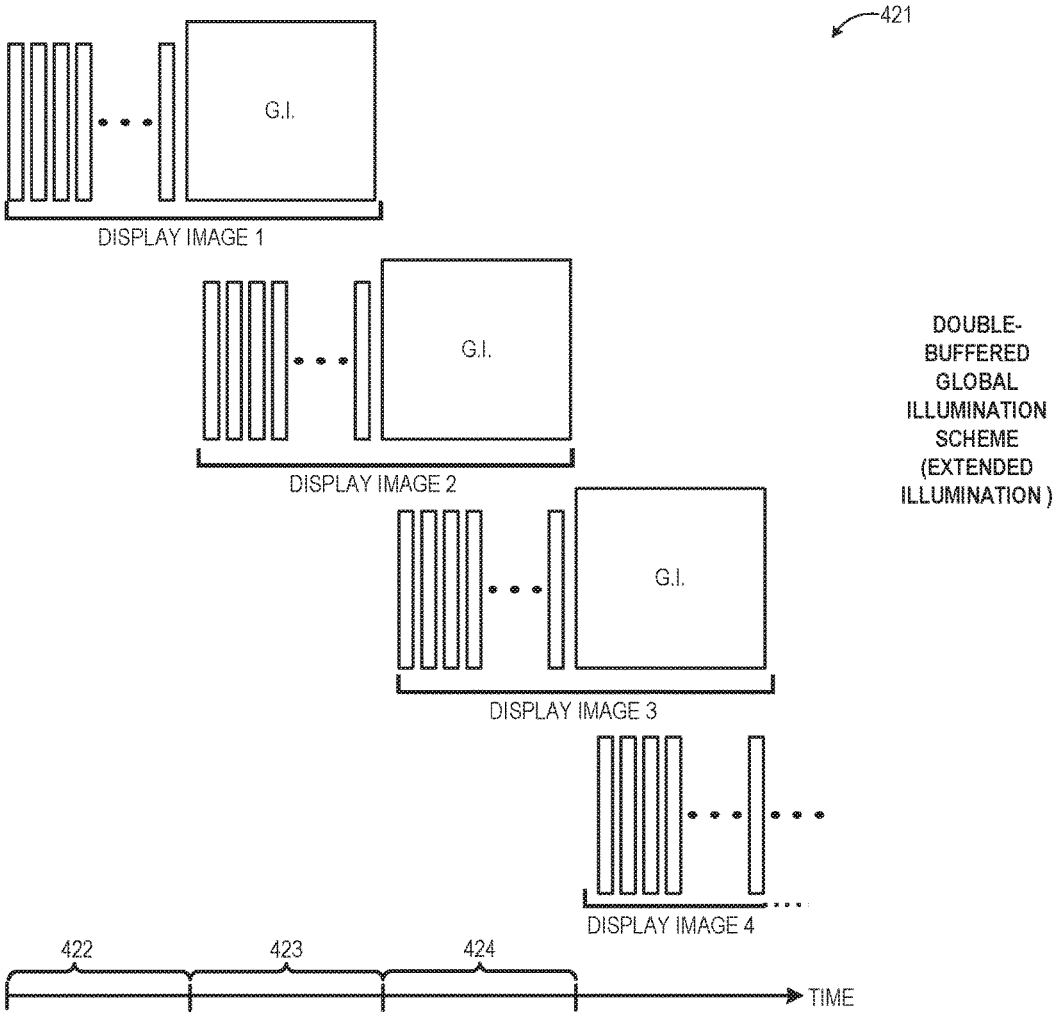

FIGS. 4 and 5 illustrate a comparison between the operation of a conventional global illumination scheme with example variations of the double-buffered global illumination scheme described above. Diagram 401 of FIG. 4 represents the operation of the conventional global illumination scheme with reference to a timeline 402. At time t0, a rendering device begins transmission of the pixel data for a display image 1 to a conventional display panel. Each narrow block (e.g., block 403) in diagram 401 represents the time needed to transmit and buffer a corresponding row of a display image. The transmission of the pixel data for display image 1 completes at time t1, and thus at time t1 or shortly thereafter the conventional display panel initiates a global illumination interval 404 having a duration from approximately time t1 to a time t2. Because the conventional display panel cannot buffer new pixel data during a global illumination interval, transmission of the next display image (display image 2) does not initiate until the global illumination interval 404 terminates at time t2. The transmission and display of the display image 2 proceeds in the same manner, as does the transmission and display of a display image 3 thereafter.

Diagram 411 of FIG. 4 represents an operation of the display system 100 of FIGS. 1 and 2 in which the duration of the global illumination intervals is the same as in the conventional display panel example of diagram 401. Likewise, the data transfer rate in this example operation is the same as in the conventional display panel example. Accordingly, the transfer of the pixel data for display image 1 occurs during time interval 412 and the global illumination interval for displaying display image 1 occurs during the following time interval 413. However, because the display panel 104 can buffer pixel data for a next display image while globally illuminating the current display image, transfer and buffering of the display image 2 can initiate during the global illumination interval 404 for display image 1 (that is, the transfer and buffering of display image 2 occurs during time interval 414, which at least partially overlaps the time interval 413). Thus the display panel 104 has completed receipt and buffering of the display image 2 earlier than would occur in a conventional display panel with the same data transfer rate and global illumination interval duration. Likewise, during the global illumination interval for display image 2 (during time interval 415), at least a portion of the transfer and buffering of a display image 3 can be performed. As a result, the effective frame period of each display image is reduced, and thus resulting in a higher effective frame rate for the display panel 104 compared to conventional display panels using a conventional global illumination scheme with the same global illumination interval and same transfer rate for the interconnect. That is, the display panel 104 in this mode of operation can provide a higher frame rate without compromising display brightness.

Turning to FIG. 5, diagram 421 represents an operation of the display system 100 of FIGS. 1 and 2 in which the duration of the global illumination intervals is increased relative to the conventional display panel example of diagram 401 while keeping the frame rate the same. As illustrated in this example, because pixel data can be received and buffered at the display panel 104 during the global illumination interval, an extended global illumination interval may be implemented. To illustrate, the global illumination interval (e.g., time intervals 422, 423, 424) for displaying one display image may be extended to encompass most or all of the time needed to transmit and buffer the next display image. This longer global illumination interval results in a brighter effective display without negatively impacting the frame rate.

Thus, as illustrated by diagrams 411 and 421, the display system 100 may be operated in a mode whereby the frame rate is increased while maintaining a typical global illumination interval or the global illumination interval may be expanded while maintaining a typical frame rater. Further, it will be appreciated that the display system 100 may implement a hybrid mode that uses slightly extended global illumination intervals, and thus providing a measure of increased effective brightness and increased frame rate.

In some embodiments, certain aspects of the techniques described above may implemented by one or more processors of a processing system executing software. The software comprises one or more sets of executable instructions stored or otherwise tangibly embodied on a non-transitory computer readable storage medium. The software can include the instructions and certain data that, when executed by the one or more processors, manipulate the one or more processors to perform one or more aspects of the techniques described above. The non-transitory computer readable storage medium can include, for example, a magnetic or optical disk storage device, solid state storage devices such as Flash memory, a cache, random access memory (RAM) or other non-volatile memory device or devices, and the like. The executable instructions stored on the non-transitory computer readable storage medium may be in source code, assembly language code, object code, or other instruction format that is interpreted or otherwise executable by one or more processors.

A computer readable storage medium may include any storage medium, or combination of storage media, accessible by a computer system during use to provide instructions and/or data to the computer system. Such storage media can include, but is not limited to, optical media (e.g., compact disc (CD), digital versatile disc (DVD), Blu-Ray disc), magnetic media (e.g., floppy disc, magnetic tape, or magnetic hard drive), volatile memory (e.g., random access memory (RAM) or cache), non-volatile memory (e.g., read-only memory (ROM) or Flash memory), or microelectromechanical systems (MEMS)-based storage media. The computer readable storage medium may be embedded in the computing system (e.g., system RAM or ROM), fixedly attached to the computing system (e.g., a magnetic hard drive), removably attached to the computing system (e.g., an optical disc or Universal Serial Bus (USB)-based Flash memory), or coupled to the computer system via a wired or wireless network (e.g., network accessible storage (NAS)).

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. A method for driving a display panel comprising an array of display elements, each display element having a corresponding light emitting diode (LED), the method comprising:

receiving, at the display panel, first pixel data representative of a first display image during a first time interval;

concurrently activating the LEDs of the array based on the first pixel data for a second time interval following the first time interval;

receiving, at a display controller of a rendering device coupled to the display panel via an interconnect, second pixel data representative of a second display image, and wherein the interconnect is compliant with at least one of: an inter-integrated circuit (I2C)-based standard; a DisplayPort-based standard; and a high-definition multimedia interface (HDMI)-based standard;

transmitting at least a portion of the second pixel data from the display controller to the display panel via the interconnect during the second time interval; and receiving and buffering the at least a portion of the second pixel data at the display panel via the interconnect during the second time interval.

2. The method of claim 1, further comprising:

concurrently activating the LEDs of the array based on the second pixel data for a third time interval following the second time interval; and initiating receipt and buffering of third pixel data representative of a third display image at the display panel during the third time interval.

3. The method of claim 1, wherein:

each display element of the array includes a first buffer stage and a second buffer stage;

receiving the first pixel data comprises storing, for each sub-pixel value of the first pixel data, a representation of the sub-pixel value at the first buffer stage of a corresponding display element of the array;

concurrently activating the LEDs of the array based on the first pixel data for the second time interval comprises transferring, for each display element of the array, the representation of the sub-pixel value from the first buffer stage of the display element to the second buffer stage of the display element and driving the LED of the display element based on the second buffer stage; and receiving and buffering of the at least a portion of the second pixel data comprises, for each sub-pixel value of at the at least a portion of the second pixel data, storing the sub-pixel value at the first buffer stage of a corresponding display element of the array during the second time interval.

4. The method of claim 3, wherein:

storing the representation of a sub-pixel value at the first buffer stage of a corresponding display element comprises storing a charge representative of the sub-pixel value at a first capacitor of the first buffer stage;

transferring the representation of a sub-pixel value from the first buffer stage of a display element to the second buffer stage of the display element comprises transferring the charge stored at the first capacitor to a second capacitor of the second buffer stage; and driving the LED of a display element based on the second buffer stage comprises driving the LED of the display element based on the charge stored at the second capacitor.

5. The method of claim 1, wherein the LEDs of the display elements of the array comprise organic LEDs (OLEDs).

6. The method of claim 1, wherein the first display image and the second display image represent virtual reality (VR) image content.

7. A system comprising:

a display panel comprising:

an input to receive pixel data representative of a sequence of display images;

an array of display elements, each display element comprising:

a first buffer stage comprising a first capacitor to store a charge representative of a sub-pixel value;

a second buffer stage coupled to the first buffer stage and comprising a second capacitor to store a charge representative of a sub-pixel value; and a light emitting diode (LED) coupled to the second buffer stage; and a controller to control the array of display elements to concurrently activate the LEDs of the array for a first time interval based on pixel data of a first display image stored at the second buffer stages of the array of display elements and to receive and store at least a portion of pixel data of a second display image at the first buffer stages of the array of display elements during the first time interval; and wherein:

each display element further includes a circuit having an input to receive a global transfer signal, the circuit to transfer the charge stored at the first capacitor to the second capacitor responsive to an assertion of the global transfer signal;

the first capacitor has a first electrode and a second electrode, the first electrode directly coupled to a ground reference;

the second capacitor has a first electrode and a second electrode, the first electrode directly coupled to the ground reference;

the first buffer stage further comprises:

a first transistor having a gate electrode coupled to a corresponding row line of the array, a first current electrode coupled to a corresponding data line of the array, and a second current electrode coupled to the second electrode of the first capacitor; and a second transistor having a gate note to receive the global transfer signal, a first current electrode coupled to the second electrode of the first capacitor, and a second current electrode coupled to the second electrode of the second transistor; and the second buffer stage further comprises:

a third transistor having a gate electrode coupled to the second electrode of the second transistor, a first current electrode coupled to a voltage reference, and a second current electrode coupled to an electrode of the LED of the display element.

8. The system of claim 7, wherein:

the controller further is to control the array of display elements to transfer the pixel data of the second display image from the first buffer stages to the second buffer stages of the array of display elements after the first time interval, and to control the array of display elements to concurrently activate the LEDs of the array for a second time interval following the first time interval based on the pixel data of the second display image stored at the second buffer stages of the array of display elements.

9. The system of claim 8, wherein:

the controller further is to control the array of display elements to store the pixel data of the first display image at the first buffer stages of the display elements of the array during a third time interval preceding the first time interval, and to transfer the pixel data of the first display image from the first buffer stages to the second buffer stages of the array of display elements before the first time interval.

10. The system of claim 7, wherein the LEDs of the display elements of the array comprise organic LEDs (OLEDs).

11. The system of claim 7, further comprising:

an interconnect coupled to the input of the display panel; and a rendering device having an output coupled to the interconnect, the rendering device to generate the sequence of display images for transmission to the display panel via the interconnect.

12. The system of claim 11, wherein:

the interconnect is compliant with at least one of: inter-integrated circuit (I2C)-based standard; a DisplayPort-based standard; and a high-definition multimedia interface (HDMI)-based standard.

13. The system of claim 7, wherein the first display image and the second display image represent virtual reality (VR) image content.

* * * * *